United States Patent [19]

Voigt

[11] Patent Number: 4,485,517

[45] Date of Patent: Dec. 4, 1984

[54] DEVICE FOR AUTOMATICALLY CLEANING MANHOLE RIMS

[76] Inventor: Lothar A. Voigt, Im Haag 2, 7148 Remseck, Fed. Rep. of Germany

[21] Appl. No.: 415,450

[22] Filed: Sep. 7, 1982

[30] Foreign Application Priority Data

Sep. 8, 1981 [DE] Fed. Rep. of Germany ..... 3135454

[51] Int. Cl.[3] ..... A46B 13/02

[52] U.S. Cl. ..... 15/246.5; 15/21 R; 15/49 R; 15/345

[58] Field of Search ..... 15/3, 28, 21 R, 49 R, 15/50 R, 98, 246.5, 104.02, 320, 385, 246, 56, 345; 51/177, 180

[56] References Cited

U.S. PATENT DOCUMENTS

| | | | |
|---|---|---|---|
| 459,486 | 9/1891 | Dunne | 15/49 R |
| 2,668,968 | 2/1954 | Dobrowolski | 15/49 R X |
| 3,922,748 | 12/1975 | Ritz | 15/246.5 |
| 4,182,001 | 1/1980 | Krause | 15/385 X |

FOREIGN PATENT DOCUMENTS

| | | | |
|---|---|---|---|
| 576560 | 5/1933 | Fed. Rep. of Germany | 15/320 |

*Primary Examiner*—Edward L. Roberts
*Attorney, Agent, or Firm*—Karl F. Ross

[57] ABSTRACT

A device for cleaning the rim of a circularly curved manhole, e.g. on a container for the storage of radioactive materials, comprises a housing temporarily held under pressure against a container wall provided with manhole to be served. A support inside the housing is rotatable about the manhole axis and has a rotary brush eccentrically mounted thereon with its bristles contacting the manhole rim. The brush mounting may be radially and/or axially adjustable for proper positioning, e.g. to clean a stepped peripheral shoulder of the rim. The support and the brush shaft are respectively driven by fluid-operated motors, and detached solid particles may be carried off by an air flow or confined to the interior of the housing.

15 Claims, 3 Drawing Figures

DEVICE FOR AUTOMATICALLY CLEANING MANHOLE RIMS

FIELD OF THE INVENTION

My present invention relates to a device for automatically cleaning the rim of a circular aperture, such as a manhole, which is formed in a container wall and is normally closed by a tightly fitting cover.

BACKGROUND OF THE INVENTION

Manholes and similar apertures of the type here considered are generally provided in the walls of containers whose interior must be accessed from time to time. Normally, a cover—which in some instances must be able to withstand internal pressures—is secured to the aperture by bolts or other suitable fasteners so that a tight seal is formed between confronting annular contact surfaces of the cover and the aperture rim. After every removal of the cover these contact surfaces must be carefully cleaned to remove incrustations and other adhering solids which would interfere with the subsequent reclosure. The cleaning of manhole rims has heretofore generally been done manually, e.g. with the aid of simple wire brushes or of hand-held tools with mechanically driven scrubbers. Such manual cleaning is cumbersome and potentially dangerous, especially in the case of containers serving to store radioactive materials in a nuclear-power plant; even persons in protective suits must not spend extended periods in such an environment so that the work must be performed in a hurry. Moreover, a uniform cleansing of the aperture rim is difficult to achieve by hand even under more favorable circumstances.

OBJECTS OF THE INVENTION

Thus, the general object of my present invention is to provide a simple device for efficiently and automatically carrying out such a cleaning operation.

A more particular object is to provide means in such a device for controlling the disposal of solid particles detached from the rim of a manhole or similar aperture in an operation of this kind.

SUMMARY OF THE INVENTION

A device according to my invention comprises, essentially, a housing that is temporarily juxtaposable with a container wall having a circular aperture whose rim is to be cleaned, the housing containing a support which is rotatable about the aperture axis in a position of alignment. The support carries surface-cleansing means, preferably one or more rotary scrubbers such as brushes, grinding wheels or honing disks, eccentrically disposed thereon for orbiting about the aperture axis.

The rotary scrubber (or set of scrubbers), referred to hereinafter for convenience as a brush, may be driven independently of the support by a separate motor, though in principle the brush drive could be derived from the support drive through a suitable transmission preferably of the step-up type. The motor or motors for the support and the bursh are advantageously of the fluidoperated (pneumatic or hydraulic) kind.

In many instances the aperture rim will be formed with a stepped peripheral shoulder accommodating a complementarily stepped plateau of the associated cover. In order to facilitate the cleaning of the several levels of such a rim, I may provide the device with adjustable mounting means enabling a radial and/or axial displacement of the brush or other surface-cleansing means. Such adjustable mounting means may comprise, for example, a fluidically or otherwise axially displaceable holder forming a track for a radially movable slider on which the brush shaft is journaled. Naturally, some radial adjustability will also be useful in order to fit the device to manholes of different diameters. In a simpler embodiment with a fixed shaft mounting I may use interchangeable brushes for this purpose.

Solid particles detached from the aperture rim by the cleaning operation may be disposed of in various controlled ways. Thus, for example, I may provide the housing with inlet and outlet ports for establishing a flow of air through its interior and into an external filter or separator; such an air flow can advantageously also be used for sweeping detached particles from the inner surface of a sight glass provided on the housing periphery. Another possibility is the substantial closure of the housing, on its side facing the container wall, by a circular shield fitting into the manhole so that the detached solids will remain confined in the interior of the housing.

BRIEF DESCRIPTION OF THE DRAWING

The above and other features of my invention will now be described in detail with reference to the accompanying drawing in which.

SPECIFIC DESCRIPTION

Figure 1:
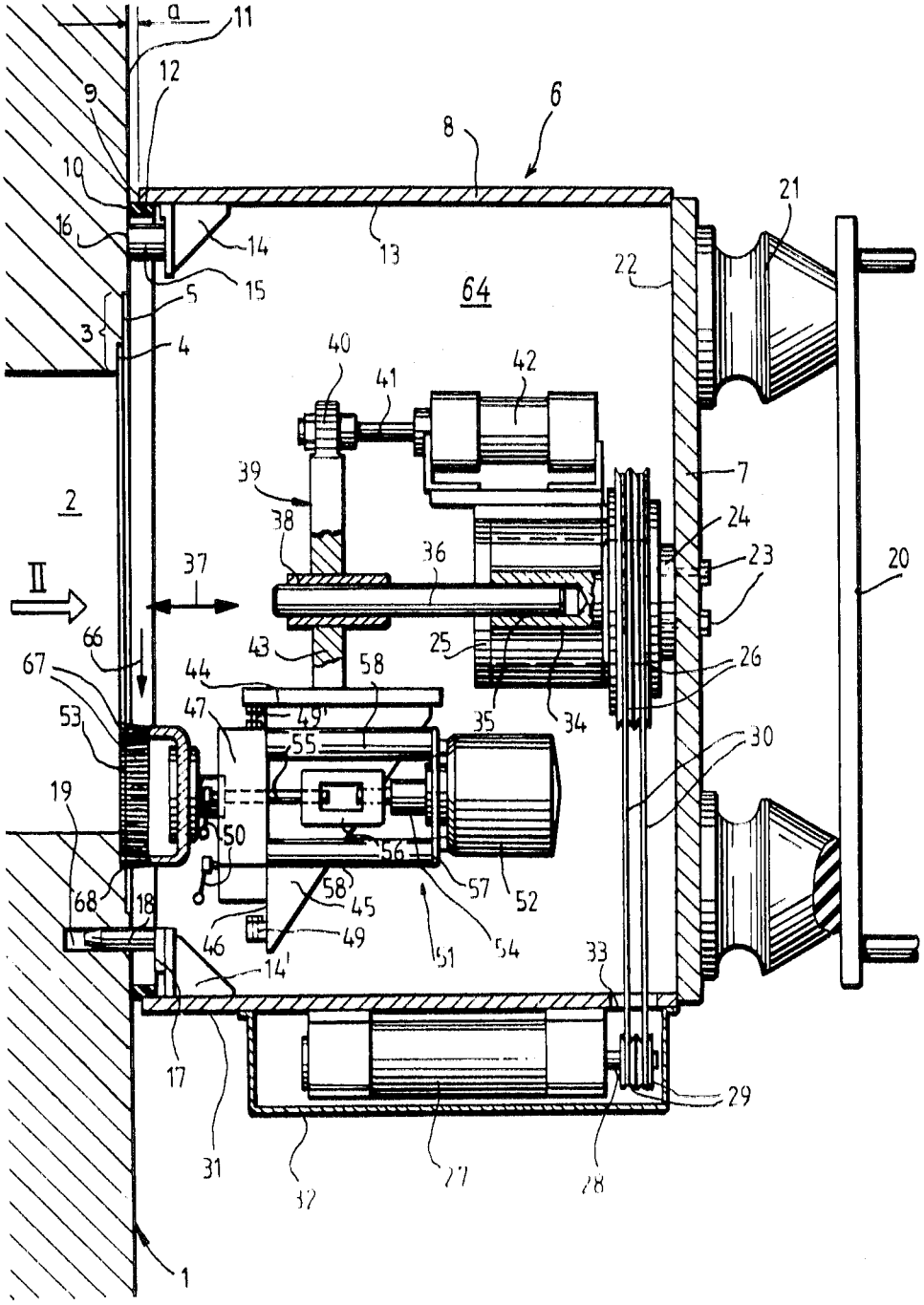
FIG. 1 is an axial sectional view of a device embodying my invention.
Figure 2:
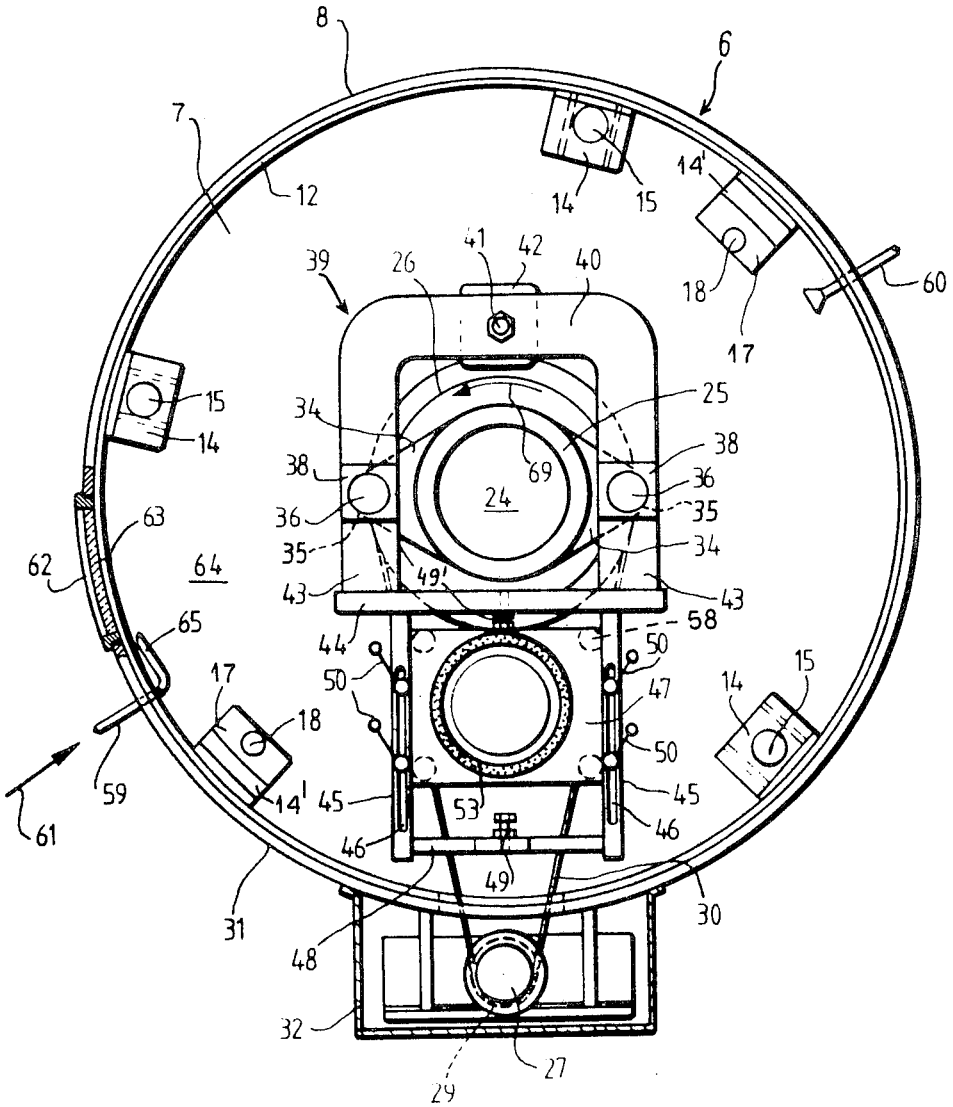
FIG. 2 is a face view of the device as seen in the direction of an arrow II in FIG. 1.

FIGS. 1 and 2 show a device 6 for the automatic cleaning of manhole rims in accordance with my invention. A flat wall 1 of an otherwise nonillustrated container has a circular manhole 2 whose annular rim 3 is stepped to form two levels 4 and 5 to which a complementarily shaped cover, not shown, is normally fitted under clamping pressure. The device 6 comprises a housing constituted by an end plate 7 and a cylindrical peripheral wall 8 centered on the manhole axis whose location is indicated by a double-headed arrow 37 in FIG. 1. A carriage movable along container wall 1, partly represented by a mounting plate 20, holds the device 6 with the aid of links 21 preferably consisting of elastomeric material, as shown. This carriage is so guided that the annular end face 9 of housing wall 8 is separated from the confronting container surface 11 by a certain clearance a bridged by an elastic skirt 12 which is fastened to the inner surface 13 of wall 8 and sealingly rests with its own end face 10 on surface 11. Clearance a is determined by several peripherally separated spacers 15 (three in the present instance) which are mounted on brackets 14 secured to the inner wall surface 13. Two other, diametrically opposite brackets 14' carry centering lugs 17 with indexing pins 18 received in bores 19 of container wall 1 when the spacers 15 rest with their end faces 16 on wall surface 11. It will be obvious that spacers 15 and pins 18 could be combined into unitary locating elements.

Centrally mounted on end plate 7, with the aid of bolts 23, is a stud 24 secured to the inner surface 22 of that plate, that stud supporting a hub 25 of a pair of pulleys 26 which are driven by V-belts 30 from a pair of smaller pulleys 29 on a shaft 28 of a preferably pneumatically operated motor 27. This motor is surrounded by a casing 32 secured to the outer surface 31 of housing wall 8 which has an opening 33 traversed by the belts 30. Two lugs 34, extending radially outward from diametrically opposite locations on the outer surface of hub 25, have blind bores 35 in which two axially oriented rods 36 are suitably held. A doubleacting fluidic jack 42, also mounted on hub 25, serves for the selective axial reciprocation of two sleeves 38 which ride on the rods 38 and are rigid with legs 43 of a yoke whose bight 40 is fastened to the piston 41 of jack 42. The two yoke legs 43, straddling the housing axis, are fastened to a carrier plate 44 which is provided with two parallel wings 45 of triangular configuration interconnected at their apices by a cross-bar 48. Wings 45 form a guide track for a slider 47 which is radially displaceable between two stops 49, 49' on bar 48 and plate 44, respectively; two pairs of eccentric clamps 50, shiftable in grooves 46 of wings 45, serve to immobilize the slider 47 in any selected radial position. It will be understood that the displacement and immobilization of the slider need not be manual, as indicated for the sake of simplicity, but could be performed by a fluidic servomotor such as the jack 42, for example.

Slider 47 is part of a brush mounting further including another plate 57, transverse to the housing axis, linked therewith by four tie rods 58. A motor 52, again preferably of the pneumatically operated type, is supported on plate 57 and has a shaft 54 linked by a coupling 56 such as a turnbuckle with a shaft 55 journaled in slider 47, the latter shaft carrying a brush 53 with a ring-cylindrical array of bristles 67. Brush 53, its mounting 47, 57, 58 and its drive motor 52 constitute a surface-cleansing implement generally designated 51.

As shown in FIG. 2, housing wall 8 is traversed at diametrically opposite locations by an inlet pipe 59 and an outlet pipe 60, with pipe 59 serving as an entrance port and pipe 60 constituting an exit port for a flow of air 61 from a nonillustrated external blower passing through the housing. Inlet pipe 59 has a bent-over leg 65 whereby incoming air is deflected peripherally past the inner surface 63 of a sight glass 62 inserted into wall 8. After entraining loose solids in the interior 64 of the housing, the air leaves through the funnel-shaped intake end of outlet pipe 60 which is connected to a filter or other receptacle for these particles.

At the beginning of a cleaning operation, with slider 47 initially retracted onto stop 49', device 6 is moved into the alignment position defined by spacers 15 and locators 18 whereupon the slider is displaced radially outward, as indicated by an arrow 66, until the bristles 67 of brush 53 are in contact with the peripheral shoulder 68 separating levels 4 and 5 of manhole rim 3 from each other. This occurs, of course, with jack 42 so operated that the tips of bristles 67 project slightly beyond the plane of the end faces 16 of stops 15. Thereafter the jack 42 may be further actuated to move the bristle tips into close contact with level 4, as observed through sight glass 62. Next, motors 27 and 52 are set in operation, the former rotating the yoke 39 counterclockwise as viewed in FIG. 2 (arrow 69) while the latter turns the brush 53 at a considerably higher speed, preferably in the same counterclockwise direction. After a certain number of revolutions the motors are stopped and the cleansing implement 51 with its holder 39, 44 is retracted by a distance corresponding to the depth of shoulder 68 so that the tips of bristles 67 lie substantially in the plane of level 5. The slider 47 is then readjusted to let the bristles contact the boundary of that level whereupon the previous procedure is repeated. Thereafter the device 6 is axially withdrawn by its carriage from container wall 1 and the manhole 2 is reclosed by its cover.

It will be apparent that the device 6 can be used with manholes of widely varying diameters, all substantially larger than that of brush 53, whose rims have one or more recessed levels of a radial width less than the brush diameter. Thanks to its compact and sturdy structure, the device can be readily decontaminated with a jet of water after being separated from the container wall.

Figure 3:
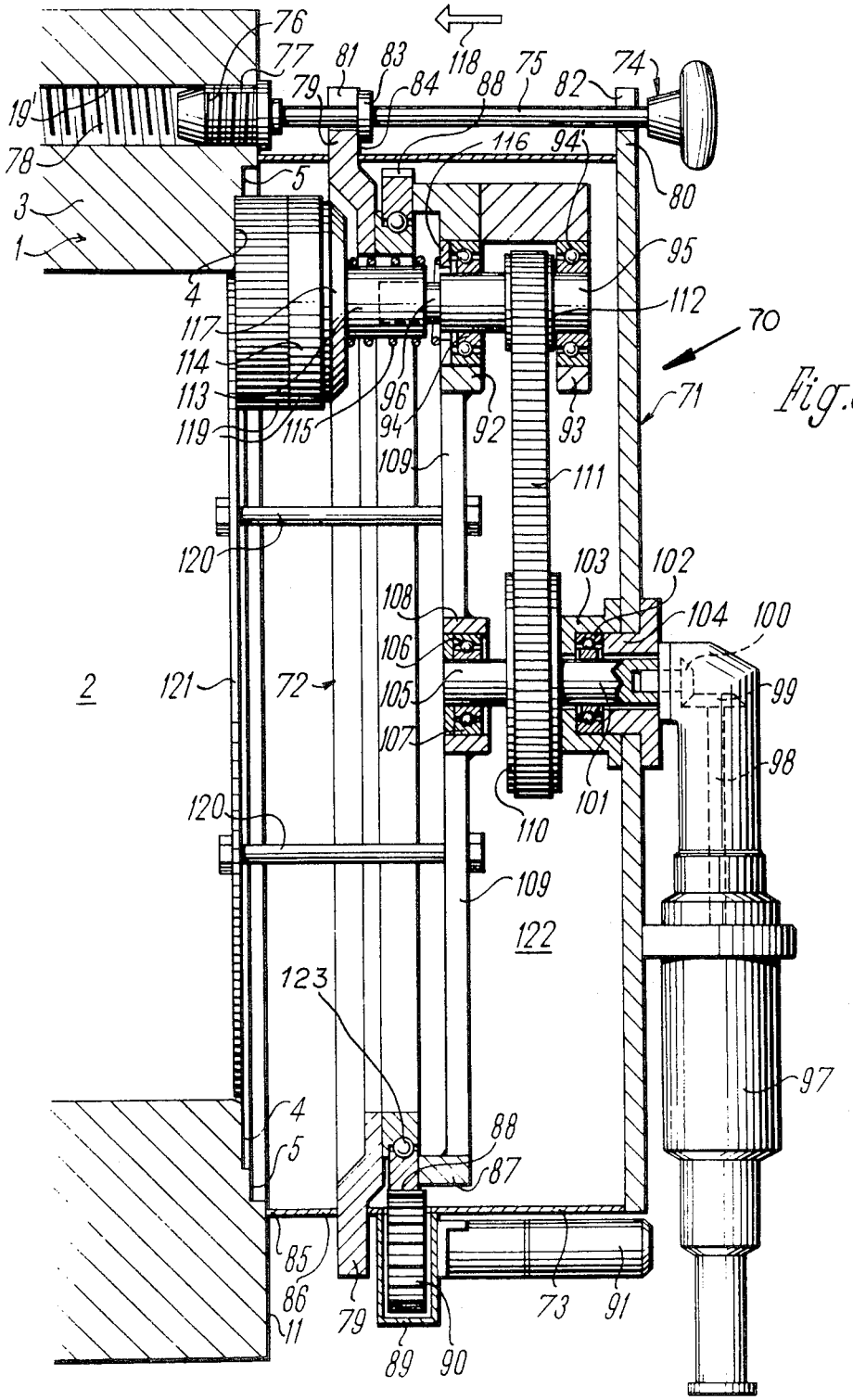
FIG. 3 is a view similar to that of FIG. 1, showing another embodiment.

In FIG. 3 I have shown a modified device 70 of the same generaly character which, in contrast to the preceding embodiment, is positively secured to the container wall 1 by, say, three peripherally equispaced clamping bolts 74 (only one shown) with stems 75 terminating in extremities 76 whose male threads 77 mate with female threads 78 of bores 19' located in wall 1. The device has a housing formed by an end plate 71, a peripheral wall 73, a track ring 72 and an extension 86 of wall 73 beyond that ring. Marginal portions 80 and 79 of plate 71 and ring 72 have respective notches 82 and 81 accommodating the stems 75 of bolts 74, these bolts further having collars 83 bearing upon a face 84 of ring 72 to force the free edge 85 of wall extension 86 into contact with wall surface 11. The several housing parts referred to are joined together by welding or soldering, for example.

A supporting ring 87 is journaled by a ball bearing 123 on track ring 72 and is provided with an array of peripheral teeth 88 meshing with a pinion 90 on a shaft of a motor 91–again preferably operated by compressed air–which is externally mounted on housing wall 73, this wall having a bulge 89 encasing the pinion 90 so as to maintain a virtually continuous separation between the interior 122 of the housing and the surrounding atmosphere. Ring 87 carries two axially spaced-apart brackets 92, 93 serving as the outer races of respective ball bearings 94, 94' in which a shaft 95 is rotatably received. Shaft 95, extending parallel to the housing axis, terminates in an extremity 96 carrying a hub 113 of a brush 114 generally similar to brush 53 of the preceding embodiment; hub 113 is slidably keyed or splined to shaft extremity 96 for rotary entrainment thereby. A compression spring 115, coiled about hub 113, is confined between a face plate 116 of bracket 92 and a brush mount 117 integral with that hub so as to urge the bristles 119 of brush 114 into operative contact with level 4 of the rim of manhole 2; see arrow 118.

Another preferably pneumatic motor 97, secured to the outside of end plate 71, has a shaft 98 driving via bevel gears 99, 100 a shaft 101 centered on the housing axis. Shaft 101 and an extremity 105 thereof carry inner races of respective ball bearings 102 and 106. The outer race of bearing 102 is held between retaining rings 103 and 104 of plate 71; the outer race 107 of bearing 106 is fitted into a hub 108 which is connected with the ring 87 by several spokes 109. Keyed to shaft 101 is a relatively large pulley 110 linked by a toothed belt 111 with a smaller pulley 112 on shaft 95 in order to drive the brush 114 at high speed.

The rotary support for the eccentrically mounted scrubbing implement including brush 114 is connected with a circular shield 121, received in manhole 2 just beyond that brush, by rods 120 secured to the spokes 109. Shield 121, rotating with that support when motor 91 is operated, approaches the peripheral surface of manhole 2 as closely as possible while partly overlying the brush 114; this prevents detached solids from escaping into the atmosphere during operation of the device. The shield also keeps the brush from ejection by the spring 115 when the drive is removed from the container wall. Upon such removal, solid particles collected in the interior 122 of the housing can be discharged into an underlying receptacle.

In this somewhat simplified embodiment the cleaning of level 5 will require the replacement of brush 114 by another brush of larger diameter. Such substitution can be readily accomplished after an unscrewing of shield 121 from spokes 109.

The mode of operation of the device 70 essentially conforms otherwise to that of the aforedescribed device 6.

I claim:

1. A device for automatically cleaning the rim of a circular aperture on a container wall, comprising:
- a housing juxtaposable with said container wall and alignable with said aperture;
- a support in said housing rotatable about the axis of said aperture;
- surface-cleansing means eccentrically disposed on said support for engagement with the rim of said aperture, said surface-cleansing means including a rotary scrubber with a shaft parallel to said axis, said support being provided with adjustable mounting means carrying said surface-cleansing means, said mounting means comprising an axially shiftable holder and a slider radially displaceable on said holder, said shaft being journaled in said slider;
- a first motor coupled with said support for rotating said surface-cleansing means about said axis; and
- a second motor coupled with said shaft for rotation of said scrubber independent of the motion of said support.

2. A device for automatically cleaning the rim of a circular aperture on a container wall, comprising:
- a housing juxtaposable with said container wall and alignable with said aperture, said housing being provided with clamping means for securing same under pressure to said container wall in a predetermined position of alignment with said aperture,
- a support in said housing rotatable about the axis of said aperture;
- surface-cleansing means eccentrically disposed on said support for engagement with the rim of said aperture, said surface-cleansing means including a rotary scrubber with a shaft parallel to said axis;
- a first motor coupled with said support for rotating said surface-cleansing means about said axis; and
- a second motor coupled with said shaft for rotation of said scrubber independent of the motion of said support.

3. A device for automatically cleaning the rim of a circular aperture on a container wall, comprising:
- a housing juxtaposable with said container wall and alignable with said aperture;
- a support in said housing rotatable about the axis of said aperture, said support being provided with adjustable mounting means including an axially shiftable holder and a slider radially displaceable on said holder;
- surface-cleansing means eccentrically disposed on said mounting means for engagement with the rim of said aperture, said surface-cleansing means including a rotary scrubber with a shaft journaled parallel to said axis in said slider; and
- drive means coupled with said support for rotating said surface-cleansing means about said axis.

4. A device as defined in claim 3 wherein said drive means comprises a first motor, said shaft being coupled with a second motor for rotation of said scrubber independent of the motion of said support.

5. A device as defined in claim 4 wherein said motors are fluid-operated.

6. A device as defined in claim 3 or 4 wherein said scrubber is a substantially ring-cylindrical brush.

7. A device as defined in claim 1 or 3 wherein said holder comprises a fluidically displaceable member forming a track for said slider.

8. A device as defined in claim 3 or 4 wherein said housing has a peripheral skirt elastically engageable with said container wall under pressure of an associated carrier movable along said container wall, said housing being further provided with spacing and indexing means for establishing a predetermined position of alignment with said aperture.

9. A device as defined in claim 3 or 1 wherein said housing is provided with inlet and outlet ports for passing an air flow therethrough to entrain solid particles detached from said rim.

10. A device as defined in claim 9 wherein said housing is provided with a sight glass having an inner surface positioned to be swept by said air flow.

11. A device for automatically cleaning the rim of a circular aperture on a container wall, comprising:
- a housing juxtaposable with said container wall and alignable with said aperture, said housing having a peripheral skirt elastically engageable with said container wall under pressure of an associated carrier movable along said container wall, said housing being further provided with spacing and indexing means for establishing a predetermined position of alignment with said aperture;
- a support in said housing rotatable about the axis of said aperture;
- surface-cleansing means eccentrically disposed on said support for engagement with the rim of said aperture; and
- drive means coupled with said support for rotating said surface-cleansing means about said axis.

12. A device for automatically cleaning the rim of a circular aperture on a container wall, comprising:
- a housing juxtaposable with said container wall and alignable with said aperture, said housing being provided with clamping means for securing same under pressure to said container wall in a predetermined position of alignment with said aperture;
- a support in said housing rotatable about the axis of said aperture;
- surface-cleansing means eccentrically disposed on said support for engagement with the rim of said aperture; and
- drive means coupled with said support for rotating said surface-cleansing means about said axis.

13. A device as defined in claim 11 or 12 wherein said surfacecleansing means comprises a rotary scrubber with a shaft parallel to said axis.

14. A device as defined in claim 12 or 2 wherein said housing is provided, at an axial location beyond said surfacecleansing means, with a circular shield receivable in said aperture for confining solid particles detached from said rim to the interior of said housing.

15. A device as defined in claim 14 wherein said shield is coupled with said support for rotation therewith.

* * * * *